US005566558A

United States Patent [19]

Tsuchiya

[11] Patent Number: 5,566,558

[45] Date of Patent: Oct. 22, 1996

[54] FABRIC SLITTING AND TAKE-UP MECHANISM FOR A CIRCULAR KNITTING MACHINE

[75] Inventor: Koji Tsuchiya, Hyogo, Japan

[73] Assignee: Precision Fukuhara Works, Ltd., Japan

[21] Appl. No.: 511,933

[22] Filed: Aug. 7, 1995

[30] Foreign Application Priority Data

Aug. 8, 1994 [JP] Japan ..... 6-208146

[51] Int. Cl.[6] ..... D04B 35/34

[52] U.S. Cl. ..... 66/151; 66/149 R; 242/525.1

[58] Field of Search ..... 66/149 R, 151, 66/152, 153, 8; 242/522, 525, 525.1; 83/872, 102

[56] References Cited

U.S. PATENT DOCUMENTS

| | | | |
|---|---|---|---|
| 3,105,283 | 10/1963 | Pernick | 242/525 X |
| 3,196,723 | 7/1965 | Cohn et al. | 242/525 X |
| 3,521,466 | 7/1970 | Tannert | 66/153 X |
| 3,718,300 | 2/1973 | Aronoff . | |
| 3,842,627 | 10/1974 | Bassist | 66/151 |
| 3,855,822 | 12/1974 | Lee | 66/151 X |
| 3,872,692 | 3/1975 | Miyagawa et al. | 66/153 X |
| 4,314,462 | 2/1982 | Ducol et al. | 66/153 X |
| 5,293,906 | 3/1994 | Amin . | |
| 5,317,885 | 6/1994 | Vignoni . | |

FOREIGN PATENT DOCUMENTS

| | | |
|---|---|---|
| 456576A1 | 11/1991 | European Pat. Off. . |
| 0534917 | 3/1993 | European Pat. Off. . |
| 3937990A1 | 5/1991 | Germany . |

*Primary Examiner*—John J. Calvert
*Attorney, Agent, or Firm*—Bell, Seltzer, Park & Gibson, P.A.

[57] ABSTRACT

A circular knitting machine and take-up mechanism therefor includes a knitting unit for forming a tubular knit fabric, a first set of let-off rolls for flattening the tubular fabric into a double-layer web and delivering the web from the knitting unit, a slitter for slitting the flattened tubular fabric longitudinally along a predetermined line, a spreader for spreading the slit fabric into a single layer web, the spreader being extendable and contractible to spread fabrics of varying widths, a second set of let-off rolls for drawing the fabric across the spreader and a fabric take-up for taking-up the single layer web for storage and subsequent use.

17 Claims, 4 Drawing Sheets

FABRIC SLITTING AND TAKE-UP MECHANISM FOR A CIRCULAR KNITTING MACHINE

FIELD OF THE INVENTION

The present invention relates to circular knitting machines and more particularly to a fabric slitting and take-up mechanism therefor.

BACKGROUND OF THE INVENTION

Circular knitting machines produce fabric in tubular form. Typically, the tubular fabric is flattened into a web of two layers of fabric joined together at opposite sides of the web. The flattened web is then wound into a roll and ultimately, the full roll is discharged from the knitting machine.

It is sometimes desirable to slit the tubular fabric and take-up the fabric as a single layer fabric. Two examples of such slitting and take-up mechanisms are disclosed in U.S. Pat. No. 5,317,885 to Vignoni and in German published patent application No. DE 39 37 990 A1 published May 16, 1991. In both examples, the flattened tubular fabric is slit at opposite side edges to form two separate, single layer webs of widths equal to the width of the flattened tubular fabric. While filling a particular need, an obvious disadvantage of these slitting and take-up mechanisms is that a single layer web of only one-half the width of the knitted fabric is produced.

Another example of a slitting and take-up mechanism that slits the tubular fabric longitudinally at a single location and spreads the fabric into a wide, single layer web is disclosed in French published application No. 0 456 576 A1, published Nov. 13, 1991. In this French slitting and take-up mechanism the tube of fabric passes around a former (sometimes referred to as a "tenter") and is then flattened by guide rollers. The flattened fabric is slit longitudinally by a cutter as it exits the guide rollers and passes over a spreader which spreads the fabric to its full width. The spread fabric is then fed through the conventional three let-off rolls and eventually is taken-up by being rolled about a take-up roll.

Significant disadvantages and deficiencies have been encountered with this French slitting and take-up mechanism. Among these disadvantages and deficiencies is that the knit fabric must travel approximately twice as far as in a conventional knitting machine before reaching the three let-off rolls which results in insufficient take-up tension. Additionally, the knitting machine and the attendant slitting and take-up mechanism are quite tall, extending to a considerable height above the floor. This height makes servicing and operation of the machine difficult and somewhat dangerous since the operators must use a stepladder to thread-up the yarn carriers, etc.

SUMMARY OF THE INVENTION

With the foregoing in mind, it is an object of the present invention to provide a circular knitting machine and a slitting and take-up mechanism therefor which obviate and overcome the aforementioned disadvantages and deficiencies.

The present invention provides a circular knitting machine of any desired, conventional type which includes a knitting unit and yarn carriers for feeding yarns to the knitting unit to produce a tubular knit fabric. The knitting machine includes a tenter, over which the tubular fabric passes, between the knitting unit and a first set of let-off rolls. Means for converging and guiding the fabric is disposed between the tenter and the first set of let-off rolls.

A slitter or cutter is disposed beneath and adjacent to the first set of let-off rolls to slit the fabric longitudinally. A spreader then spreads the fabric to its full width and guide rolls guide the spread fabric to a second set of let-off rolls. The spread fabric is then taken-up by a take-up means in either roll form or folded form. As a result, the fabric produced by the knitting unit must travel no more than the normal distance to the first set of let-off rolls and proper take-up tension can be maintained.

Preferably, the spreader is a trapezoidal guide having four sides that are extendable and contractible. Also, it is preferred that three of the four sides of the spreader be in the form of rollers that are mounted at each end by bearings so that no appreciable resistance or tension is applied to the fabric.

It is also preferred that an attendant supporting platform or floor be provided at the level of the base of the circular knitting machine so that an attendant may stand or walk thereon while operating or servicing the knitting machine. This platform may be an upper floor of a factory while the slitting and take-up mechanism is located in a hole in that upper floor and extends down to and is supported by a lower floor of the factory.

BRIEF DESCRIPTION OF THE DRAWINGS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

DETAILED DESCRIPTION OF THE PREFERRED EMBODIMENTS

Figure 1:
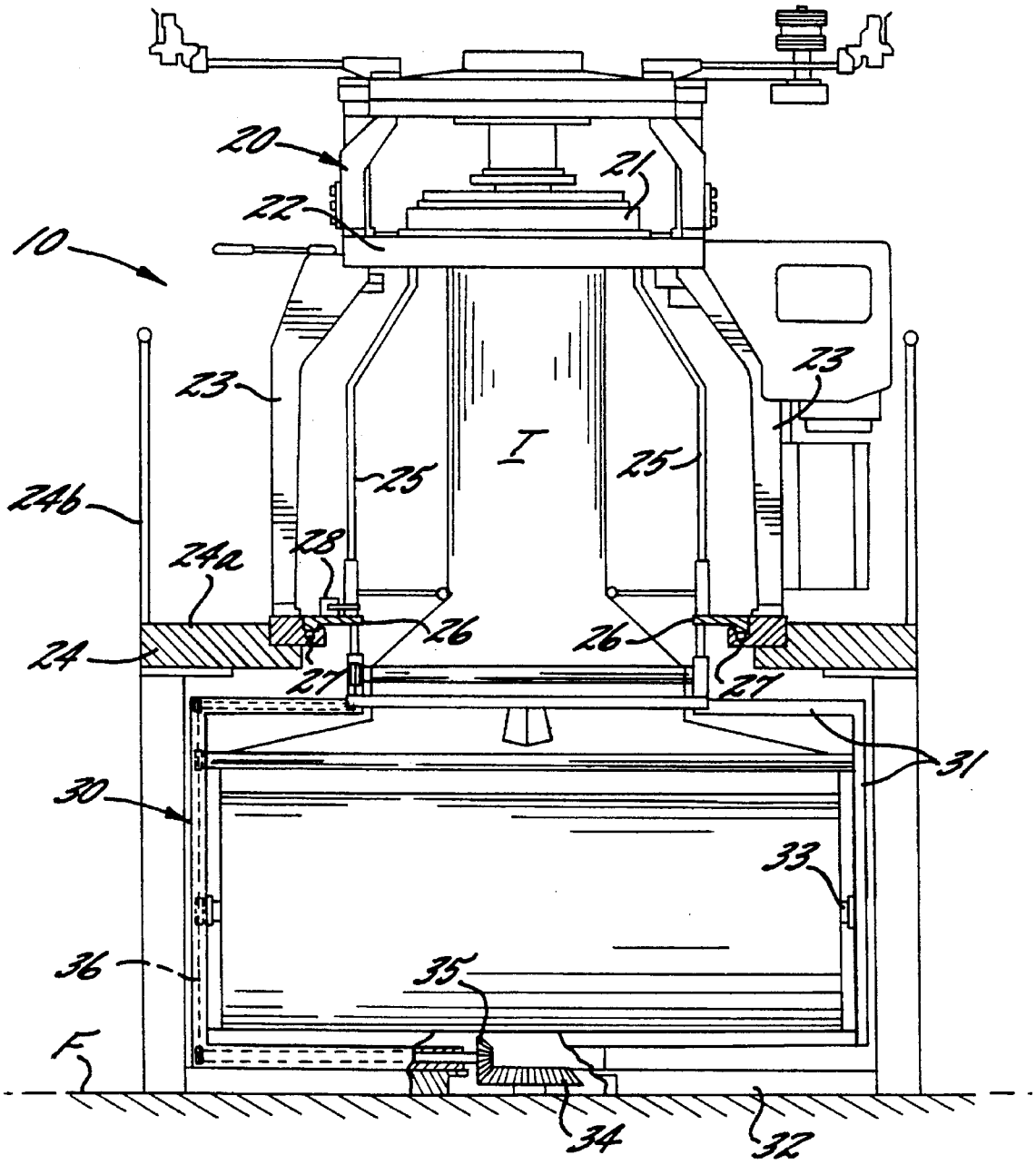
FIG. 1 is a front elevation, partially in section, of a circular knitting machine and slitting and take-up mechanism in accordance with the present invention.

Referring now more specifically to the drawings and particularly to FIG. 1, there is illustrated an apparatus, generally indicated at 10, which includes a circular knitting machine, generally indicated at 20, and a fabric slitting and take-up mechanism, generally indicated at 30, incorporating the features of the present invention. Circular knitting machine 20 includes a knitting unit 21 which in turn includes a cylinder, a dial and yarn carriers (all of which are conventional). Knitting unit 21 is supported on a bed 22 which in turn is supported by a plurality of legs 23 on a platform 24. Platform 24 has an attendant supporting surface 24*a* which surrounds the knitting machine 20. Preferably, a guard rail 24*b* is provided on platform 24 for worker safety. The platform 24 may be a platform supported above the floor F of a factory or platform 24 can be an upper floor while the floor F is a lower floor.

Figure 2:
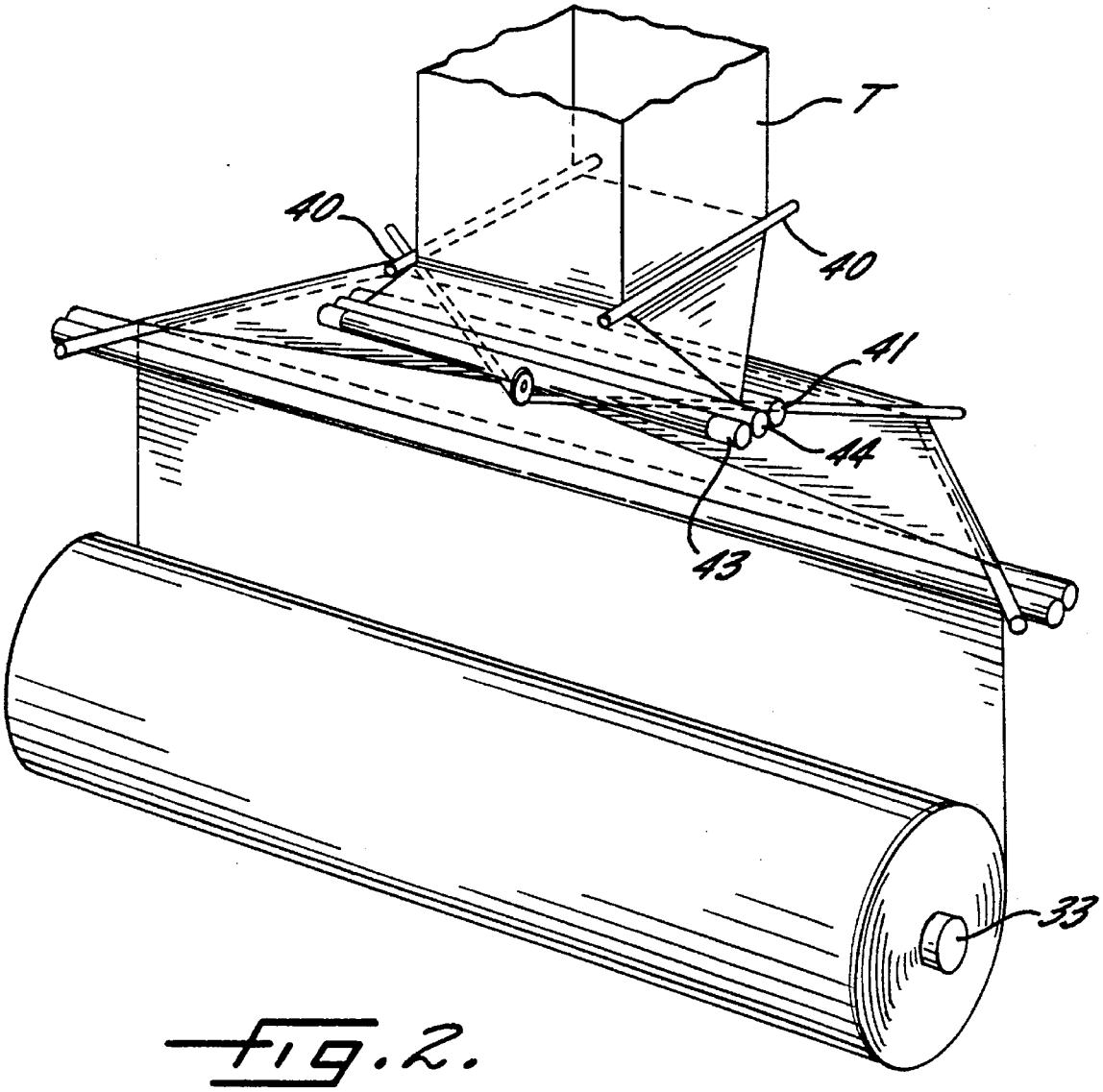
FIG. 2 is a fragmentary, partially schematic, perspective view of the slitting and take-up mechanism of FIG. 1.

The knitting unit 21 produces a tubular knit fabric T which is delivered downwardly inside the cylinder in conventional manner. A tenter (not shown) is provided inside the fabric T beneath the knitting unit 21 and smoothes and forms the fabric T into a parallelopipedic shape (FIG. 2). A tenter of this type is shown and described in U.S. Pat. No. 4,314,462 and such disclosure is incorporated herein by reference.

Figure 5:
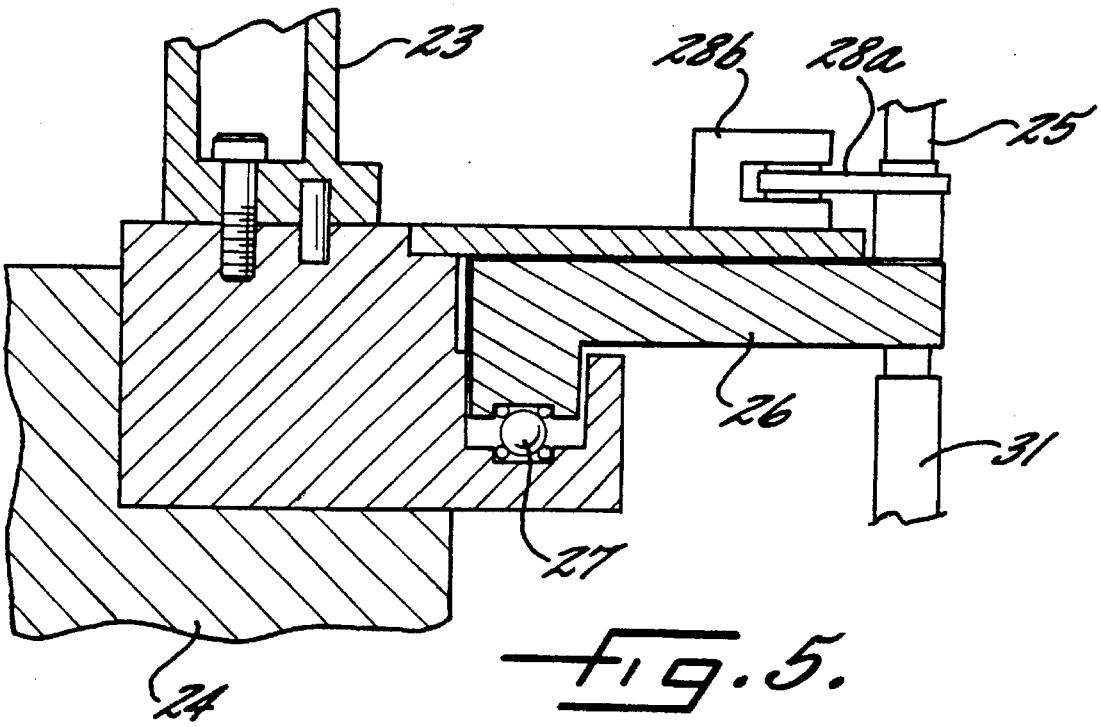
FIG. 5 is an enlarged, fragmentary sectional view of the transmission ring for the slitting and take-up mechanism shown in the medial portion of FIG. 1.

As the cylinder and dial of the knitting unit 21 rotate, the fabric T also rotates. To synchronize rotation of the cylinder and fabric with the slitting and take-up mechanism 30, the knitting machine 20 includes a pair of transmission arms 25 which are connected at their upper ends to the cylinder and are supported at their lower ends by a transmission ring 26 (FIG. 5). Transmission ring 26 is rotatably supported on platform 24 by a ball bearing 27. A suitable brake 28, preferably a disc brake, has a disc portion 28*a* carried by the transmission arms 25 and a pad portion 28*b* carried by the platform 24. Brake 28 ensures that the transmission ring 26 and the slitting and take-up mechanism 30 will stop when the knitting unit stops and will not overrun or backlash.

Slitting and take-up mechanism 30 includes a pair of side frames 31, the upper ends of which are connected to and suspended from transmission ring 26 (FIGS. 1 and 5). A bottom frame 32 connects the lower ends of side frames 31. A take-up roller 33 is journaled for rotation at its opposite ends in side frames 31 and is driven in rotation to wind the fabric T thereon in roll form. Roller 33 is driven by a stationary bevel gear 34 mounted on the bed of the machine and a revolving bevel gear 35 carried by the bottom frame 32 for being driven in rotation by stationary bevel gear 34 as gear 35 revolves therearound. Revolving bevel gear 35 is connected by a transmission means 36 to take-up roller 33.

Below the tenter (not shown) a pair of guide rollers 40 are rotatably supported from the transmission arms 25 and engage the fabric T on the sides thereof perpendicular to the plane of the fabric after it is flattened. Guide rollers 40 control the fabric and prevent deformation of the parallelopipedic shape to a location well below the tenter.

Figure 3:
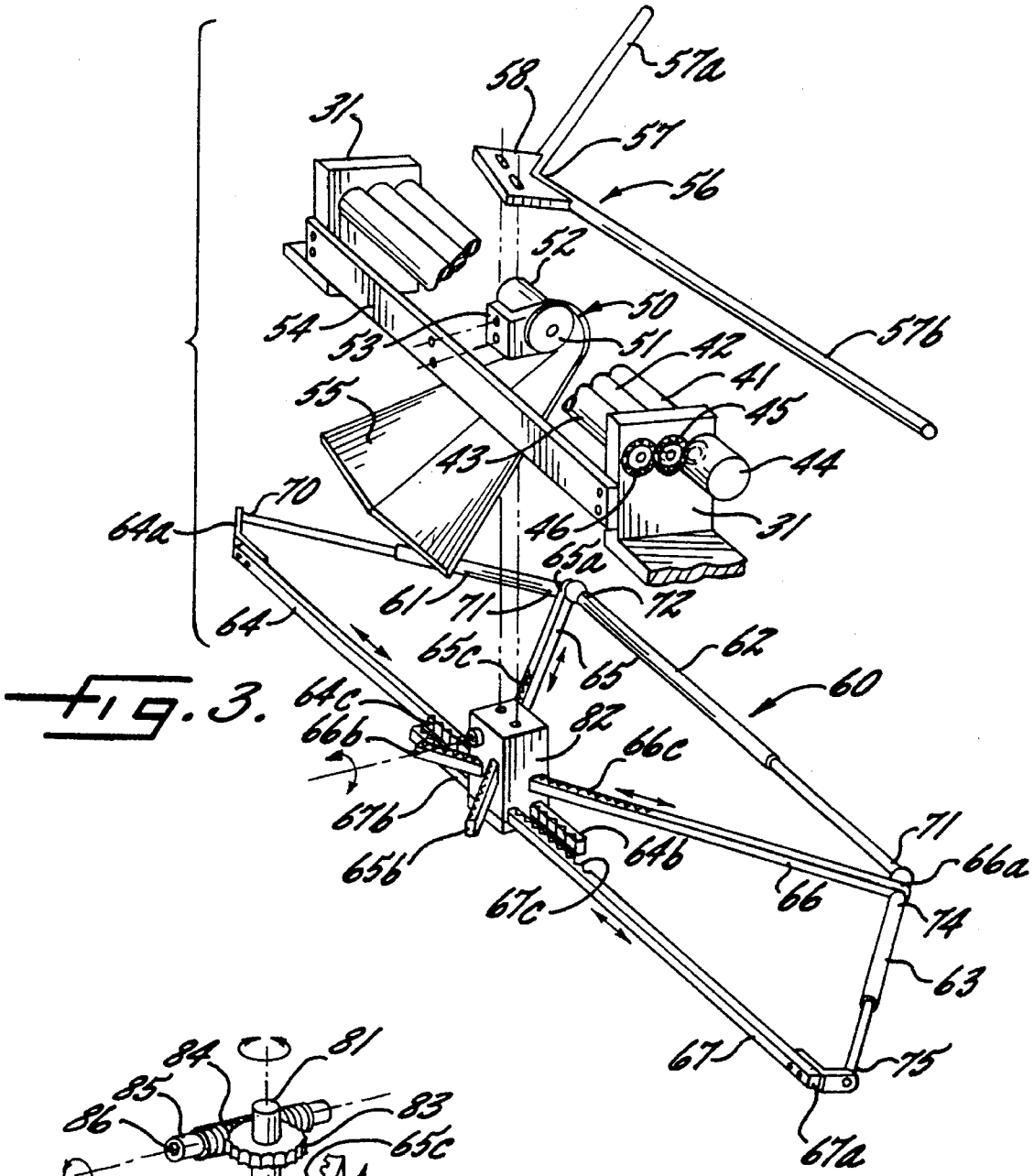
FIG. 3 is an enlarged, fragmentary, partially schematic, perspective view of the slitter and spreader shown in the medial portion of FIG. 2.

A first set of let-off rolls 41, 42 and 43 are disposed beneath the guide rollers 40 and are perpendicular thereto. Let-off rolls 41, 42 and 43 are journaled for rotation in side frames 31 (FIG. 3). Roll 41 is driven by a motor 44 and rolls 42 and 43 are driven by roll 41 by gears 45, 46. The fabric is fed between the rolls 41 and 42, passes around the bottom of roll 42, travels upwardly between rolls 42 and 43, around the top of roll 43 and thence downwardly therefrom. The motor 44 is preferably controlled by an outside control means (not shown) depending on the throughput of the fabric.

A slitting or cutting means 50 is mounted in the middle of the fabric exiting from the roll 43. Preferably, slitting means 50 includes a disc cutter 51 mounted on the output shaft of a motor 52. Cutter 51 and motor 52 are mounted on a holder 53 which in turn is mounted on a bar 54. Bar 54 is mounted at its opposite ends on side frames 31. A cutter cover 55 is mounted on holder 53 and covers all of cutter 51 except the portion thereof that has to be exposed to slit the fabric for safety and, also, to prevent dust and lint, generated during slitting of the fabric, from adhering to the fabric.

Fabric guiding means 56 is provided between slitting means 50 and let-off rolls 41, 42 and 43. Guiding means 56 includes a V-shaped guide 57 formed of two guide rollers 57*a* and 57*b* supported by a guide holder 58. Guide holder 58 is in turn mounted on cutter holder 53. Preferably, guide rollers 57*a* and 57*b* are journaled for rotation by bearings (not shown) so that substantially no resistance or tension is applied to the fabric.

A fabric spreading means 60 is disposed below the fabric slitting means 50 in close proximity to the fabric guiding means 56 for cooperation therewith in spreading the slit fabric to its full width as a single layer web. Spreading means 60 includes three guide rollers 61, 62 and 63 and a plurality of mounting and adjustment bars 64, 65, 66 and 67 which are arranged in a trapezoidal shape. The guide rollers 61, 62 and 63 are freely adjustable lengthwise to accommodate and spread fabrics of varying widths. To this end, the guide rollers 61, 62 and 63 are formed of telescoping members 61*a*, 61*b*; 62*a*, 62*b* and 63*a*, 63*b*, respectively. Preferably, the guide rollers 61, 62 and 63 each have opposite ends thereof mounted by bearings as indicated at 70, 71, 72, 73, 74 and 75 in FIG. 3 so that substantially no resistance or tension is applied to the fabric thereover.

Figure 4:
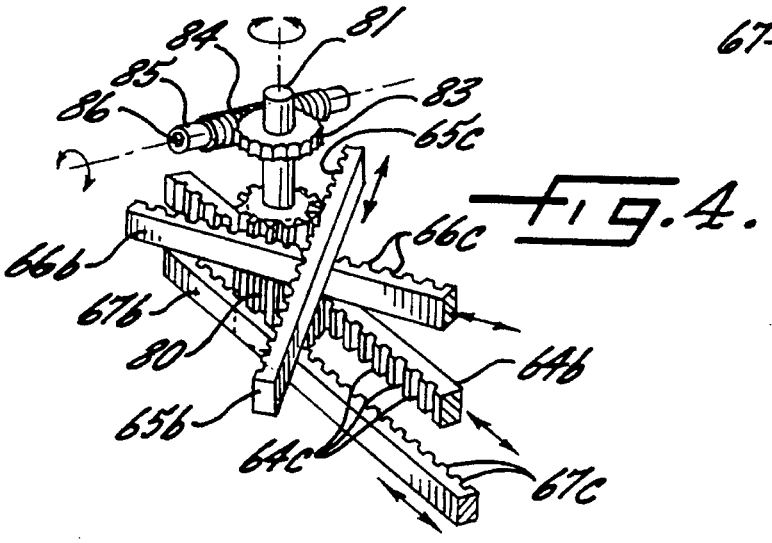
FIG. 4 is an enlarged, fragmentary, partially schematic, perspective view of the adjustment mechanism, with the cover removed, for the spreader shown in FIG. 3.

For simultaneous adjustment of the lengths of the guide rollers 61, 62 and 63, the mounting and adjustment bars 64, 65, 66 and 67 have their outer ends 64*a*, 65*a*, 66*a* and 67*a* connected to the guide rollers 61, 62 and 63, with bar 64 having its outer end 64*a* connected to one end of roller 61; bar 65 having its outer end 65*a* connected to the juncture of rollers 61 and 62; bar 66 having its outer end 66*a* connected to the juncture of rollers 62 and 63; and bar 67 having its outer end 67*a* connected to the other end of roller 63. The inner ends 64*b*, 65*b*, 66*b* and 67*b* of bars 64, 65, 66 and 67 have rack teeth 64*c*, 65*c*, 66*c* and 67*c* formed therein. The rack teeth 64*c*, 65*c*, 66*c* and 67*c* mesh with a pinion gear 80 mounted on a shaft 81 in a gear box 82 (FIGS. 3 and 4). A second pinion gear 83 is also mounted on shaft 81 for rotation therewith. Second pinion gear 83 meshes with a worm gear 84 mounted on a shaft 85 which extends to the exterior of gear box 82 and has a tool engaging cavity 86 in the outer end thereof.

To adjust the spreading means 60 to accommodate fabric of a different width, a suitable tool (not shown), such as a crank or ratchet, is inserted into cavity 86 in shaft 85 and is used to turn the shaft 85 in one direction to increase the size of the spreading means 60 and in the opposite direction to decrease the size thereof. Rotation of shaft 85 rotates worm gear 84 which in turn drives second pinion gear 83. Second pinion gear 83 rotates shaft 81 which rotates first pinion gear 80. First pinion gear 80 simultaneously moves the bars 64, 65, 66 and 67 either outwardly or inwardly through rack teeth 64*c*, 65*c*, 66*c* and 67*c* to lengthen or shorten the guide rollers 61, 62 and 63.

The slit and spread fabric leaving the fabric spreading means 60 passes through the nip of a pair of second let-off rolls 90, 91 disposed beneath the spreading means 60. Second let-off rolls 90, 91 are driven in synchronism with first let-off rolls 41, 42 and 43 and deliver the spread fabric to the take-up roller 33. Take-up roller 33 then winds the slit and spread fabric into a roll.

Figure 6:
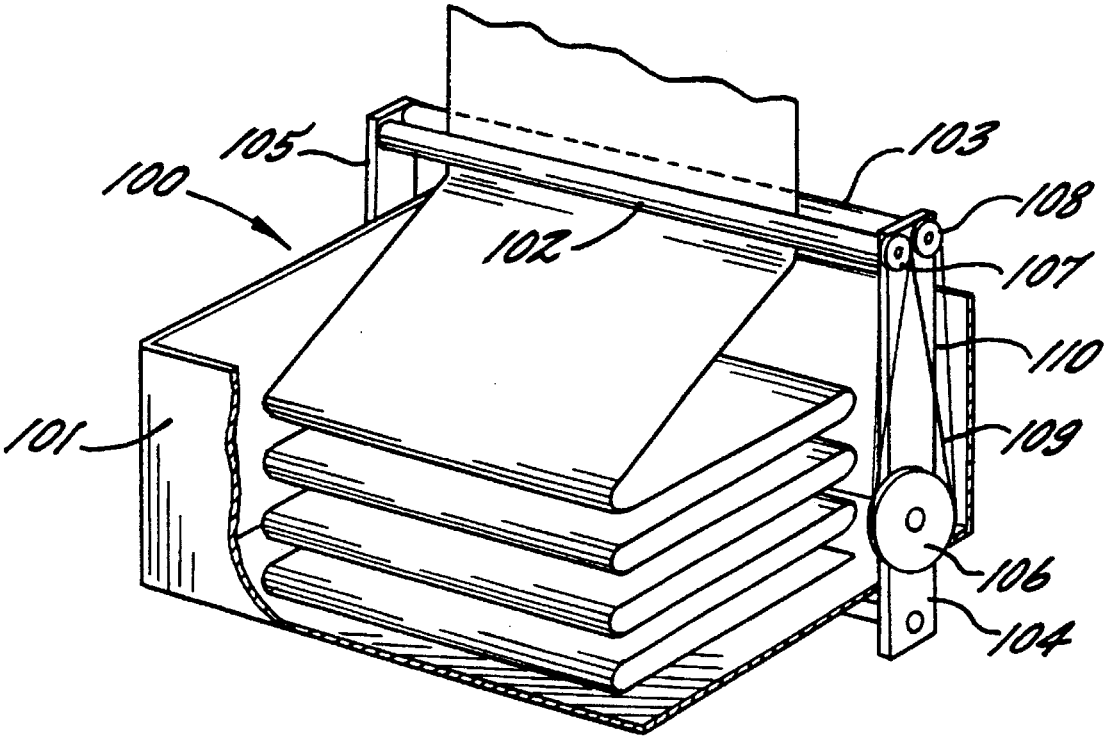
FIG. 6 is a perspective view of another embodiment of a take-up device for receiving and folding the fabric in a storage container.

Alternatively to take-up roller 33, a fabric take-up means 100 in the form of an accordion folding means may be used as illustrated in FIG. 6. Take-up means 100 includes a fabric storage bin 101 for receiving and storing the folded fabric.

A pair of laterally reciprocating rolls 102, 103 are mounted above bin 101 by a pair of arms 104, 105. Rolls 102, 103 are driven in any suitable manner, such as by a drive pulley 106 and driven pulleys 107, 108 and by drive belts 109, 110. Drive pulley 106 is driven in a manner not shown by any synchronous drive source, such as, for example, transmission means 36.

Rolls 102, 103 may be reciprocated horizontally by arms 104, 105 or may be moved in an arc by the arms 104, 105 pivoting about an axis at the lower ends thereof. Alternatively, the rolls 102, 103 and arms 104, 105 may be stationary and the bin 101 may be reciprocated horizontally beneath the rolls 102, 103.

The present invention provides a circular knitting machine 20 and slitting and spreading fabric take-up mechanism 30 in which the fabric is slit, spread and taken-up in such a manner that sufficient tension in the fabric can be maintained and in which the fabric is guided in its take-up path of travel by guide means which add substantially no tension to the fabric. Additionally, the take-up mechanism 30 of the present invention is versatile in that it can be used with a variety of circular knitting machines producing fabrics of varying widths.

Replacement of one circular knitting machine with another is easily accomplished by disconnecting the legs 23 from platform 24 and transmission arms 25 from ring 26. The circular knitting machine may then be lifted away and another machine placed above the mechanism 30 and connected to the platform 24 and to take-up mechanism 30.

The platform or upper floor 24 provides safety for machine attendants and ease in servicing, operating and maintaining the circular knitting machine.

In the drawings and the specification, there has been set forth preferred embodiments of the invention and, although specific terms are employed, the terms are used in a generic and descriptive sense only and not for purpose of limitation, the scope of the invention being set forth in the following claims.

That which is claimed is:

1. A circular knitting machine and take-up mechanism for producing a single layer web of knit fabric comprising knitting means for forming a tubular knit fabric, first let-off rolls means for receiving the tubular fabric from said knitting unit, flattening the fabric into a double-layer web and for delivering the fabric from the circular knitting machine under controlled tension, slitting means beneath and adjacent to said first let-off roll means for slitting the fabric longitudinally along a predetermined line, spreading means adjacent said slitting means for spreading the slit fabric into a single layer web said spreading means being adjustable, second let-off roll means beneath and adjacent to said spreading means for receiving the single layer web and for drawing the web across said spreading means, and web take-up means for taking-up the web for storage and subsequent use.

2. A circular knitting machine and take-up mechanism according to claim 1 wherein said slitting means is located medially of said first let-off roll means to slit one layer of the flattened tubular fabric along a predetermined medial line.

3. A circular knitting machine and take-up mechanism according to claim 2 wherein said spreading means comprises a plurality of guide rollers divergingly arranged to spread the slit fabric, and bearings mounting said guide rollers for substantially free rotation so that substantially no tension is applied to the fabric by said spreading means.

4. A circular knitting machine and take-up mechanism according to claim 3 wherein said guide rollers are adjustable lengthwise to spread fabric of varying widths.

5. A circular knitting machine and take-up mechanism according to claim 1 wherein said spreading means comprises a trapezoidal guide of four sides, each of which is extendable and contractible to spread fabric of varying widths.

6. A circular knitting machine and take-up mechanism according to claim 5 wherein three of the four sides of said trapezoidal guide comprise guide rollers which are extendable and contractible lengthwise.

7. A circular knitting machine and take-up mechanism according to claim 6 wherein each of said guide rollers have telescoping sections which are extendable and retractable relative to each other.

8. A circular knitting machine and take-up mechanism according to any of claims 5, 6 and 7 wherein said spreading means further comprises adjustment means for simultaneously extending or retracting the sides of said trapezoidal guide.

9. A circular knitting machine and take-up mechanism according to claim 1 wherein said take-up means comprises a driven take-up roller for winding the web of fabric into a roll.

10. A circular knitting machine and take-up mechanism according to claim 1 wherein said take-up means comprises means for folding the web of fabric in accordion folds and fabric storage means for receiving and storing the accordion folded fabric.

11. A take-up mechanism for a circular knitting machine for taking-up tubular fabric knitted by the circular knitting machine comprising first let-off roll means for delivering the tubular fabric from the circular knitting machine as a flattened, two layer web, slitting means beneath and adjacent said first let-off roll means for slitting the tubular fabric longitudinally along a predetermined line, spreading means beneath and adjacent said slitting means for spreading the slit fabric into a single layer web, said spreading means being extendable and contractible for spreading fabric of varying widths.

second let-off roll means beneath and adjacent said spreading means for drawing the web of fabric across said spreading means, and web take-up means for taking-up the web of fabric for storage and subsequent use.

12. A take-up mechanism according to claim 11 wherein said spreading means comprises a trapezoidal guide of four sides, each of which is extendable and contractible.

13. A take-up mechanism according to claim 12 wherein three of the four sides of said trapezoidal guide comprise guide rollers extendable and contractible lengthwise.

14. A take-up mechanism according to claim 13 wherein said guide rollers have telescoping sections which are extendable and contractible relative to each other.

15. A take-up mechanism according to any of claims 12, 13 and 14 wherein said spreading means further comprises adjustment means for simultaneously extending and retracting the sides of said trapezoidal guide.

16. A take-up mechanism according to either of claims 13 or 14 including bearings mounting said guide rollers for substantially free rotation so that substantially no tension is applied to the fabric by said spreading means.

17. A circular knitting machine and take-up mechanism comprising knitting means for forming a tubular knit fabric, platform means for supporting said knitting means at a predetermined height and including attendant supporting means surrounding said knitting means, said platform means including an opening therein for permitting the tubular knit fabric to pass downwardly therethrough, and fabric take-up means beneath said platform means and connected to said knitting means for receiving and taking-up the knit fabric formed by said knitting means, said take-up means comprises first let-off roll means mounted adjacent said platform means for delivering the tubular fabric formed by said knitting means, slitting means beneath said first let-off roll means for slitting the tubular fabric longitudinally along a predetermined line, spreading means for spreading the slit fabric into a single layer web, second let-off roll means beneath and adjacent said spreading means for drawing the web across said spreading means and web take-up means for taking-up the web for storage and subsequent use.

* * * * *